US008574799B2

(12) United States Patent
Adachi

(10) Patent No.: US 8,574,799 B2
(45) Date of Patent: Nov. 5, 2013

(54) ELECTROPHOTOGRAPHIC PHOTORECEPTOR

(75) Inventor: Takahiro Adachi, Ibaraki (JP)

(73) Assignee: Mitsubishi Gas Chemical Company, Inc., Tokyo (JP)

( * ) Notice: Subject to any disclaimer, the term of this patent is extended or adjusted under 35 U.S.C. 154(b) by 698 days.

(21) Appl. No.: 12/227,356

(22) PCT Filed: May 16, 2007

(86) PCT No.: PCT/JP2007/060004
§ 371 (c)(1),
(2), (4) Date: May 20, 2009

(87) PCT Pub. No.: WO2007/132875
PCT Pub. Date: Nov. 22, 2007

(65) Prior Publication Data

US 2009/0239167 A1 Sep. 24, 2009

(30) Foreign Application Priority Data

May 16, 2006 (JP) ..... 2006-136019

(51) Int. Cl.
*G03G 15/04* (2006.01)

(52) U.S. Cl.
USPC ..... 430/69; 430/61; 430/66; 430/70; 430/96

(58) Field of Classification Search
USPC ..... 430/66, 96, 61, 69, 70; 528/196, 198
See application file for complete search history.

(56) References Cited

U.S. PATENT DOCUMENTS

| | | | | |
|---|---|---|---|---|
| 5,292,607 | A * | 3/1994 | Aso et al. | 430/96 |
| 5,561,017 | A | 10/1996 | Nagao et al. | |
| 5,576,413 | A * | 11/1996 | Bussink et al. | 528/196 |
| 6,258,498 | B1 * | 7/2001 | Kawahara et al. | 430/66 |
| 2006/0073400 | A1 | 4/2006 | Kumano | |

FOREIGN PATENT DOCUMENTS

| | | | |
|---|---|---|---|
| EP | 0 801 330 | | 10/1997 |
| JP | 2000-162793 | * | 6/2000 |
| JP | 2002-82455 | | 3/2002 |
| JP | 2004-354759 | | 12/2004 |
| JP | 2005-84274 | | 3/2005 |
| JP | 2005-99791 | | 4/2005 |

OTHER PUBLICATIONS

Machine Translation of JP2000-162793 published Jun. 16, 2000.*
International Search Report issued Jun. 12, 2007 in the International (PCT) Application PCT/JP2007/060004 of which the present application is the U.S. National Stage.
Supplementary European Search Report dated Dec. 5, 2011 in corresponding European Application No. 07 74 3439.

* cited by examiner

*Primary Examiner* — Thorl Chea
(74) *Attorney, Agent, or Firm* — Wenderoth, Lind & Ponack, L.L.P.

(57) ABSTRACT

This invention provides an electrophotographic photoreceptor having improved resistance to soiling by a human body-derived substance and a high image stability. The electrophotographic photoreceptor comprises an electroconductie substrate and a photosensitive layer provided on the substrate and is characterized in that the photosensitive layer contains, as a binder resin, a polycarbonate resin comprising constituent units represented by the following formula (A) and the following formula (B), wherein $R_1$ to $R_4$ represent a hydrogen atom, a methyl group or the like; and X represents an alkylene group or the like. 3 to 50% by weight of the total constituent units is accounted for by the constituent units of formula (A) and the intrinsic viscosity is 0.3 to 2 dl/g. [Chemical formula 1] (A)(B).

(A)

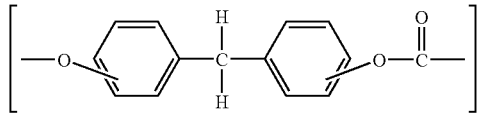

(B)

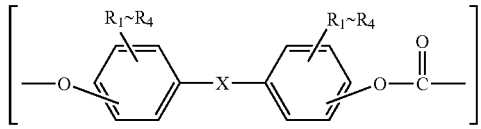

8 Claims, No Drawings

ELECTROPHOTOGRAPHIC PHOTORECEPTOR

TECHNICAL FIELD

The present invention relates to an electrophotographic photoreceptor. More precisely, the present invention relates to an electrophotographic photoreceptor using a specific polycarbonate resin as a binder resin which is produced by using a specific solvent.

BACKGROUND ART

Currently, the electrophotographic technology is widely applied for copying machines, laser beam printers (hereinafter, "LBP"), fax machines or the like because of its high-speed processability, high image quality and so on.

As an electrophotographic photoreceptor in the field of this electrophotographic technology, inorganic photoconductive substances such as selenium, selenium/tellurium alloys, selenium/arsenic alloys, cadmium sulfide or the like have mainly been used conventionally. However, from the viewpoint of its toxicity, safety, cost, productivity or the like, electrophotographic photoreceptors using organic photoconductive substances have been developed these days.

When the organic photoconductive substance is a low molecular-weight substance, it is a general practice to mix the organic photoconductive substance with a binder resin to form a coating film. As the binder resin, various thermoplastic resins and thermosetting resins such as polymethylmethacrylate, polystyrene, vinyl polymers such as polyvinyl chloride and copolymers thereof, polycarbonate, polyester, polysulfon, phenoxy resins, epoxy resins and silicone resins have been used.

The electrophotographic photoreceptor using said various binder resins can be formed into a thin film with ease by means of a cast film-forming method. Moreover, it is suitable for mass production and can be provided relatively at a low price.

Of these various resins, polycarbonate resins show relatively excellent characteristics and hence are used popularly. Among them, a polycarbonate resin produced from 1,1-bis(4-hydroxyphenyl)cyclohexane (hereinafter, "bisphenol Z") is used as a binder resin which is excellent not only in compatibility with an organic photoconductive substance but also in solvent solubility and abrasion resistance (Patent Document 1).

In recent years, handling of electrophotographic photoreceptors overseas is progressing quickly. In these circumstances, electrophotographic photoreceptors would be exposed to unexpected service environment on occasion according to the situation of each country.

A binder resin using the polycarbonate resin produced from bisphenol Z is excellent in solvent solubility but then is poor in solvent resistance. Therefore, there was a case where the surface of an electrophotographic photoreceptor was contaminated and the copied image was deteriorated in a scene where contamination by a human body-derived substance from an operator was assumed such as a scene of treating an electrophotographic photoreceptor in the process of producing, a scene of installing an electrophotographic photoreceptor to a toner cassette and a scene of replacing a toner cassette wherein an electrophotographic photoreceptor was loaded.

In the meantime, in the process of producing an electrophotographic photoreceptor, the environmental problem refrains from use of halogenated hydrocarbon. Therefore, a solvent containing tetrahydrofuran (hereinafter, "THF") which is a non-halogen solvent as a main component has become a mainstream and thus, dissolving to this solvent in a high concentration has become the essential qualification required for a binder resin. Patent Document 1: Jpn. Pat. Publication No. S60-172044

DISCLOSURE OF THE INVENTION

Problems to be Solved by the Invention

The problem to be solved by the present invention is to provide an electrophotographic photoreceptor having improved resistance to soiling by human body-derived substances such as skin fat, fat of nose and fat of hand, wherein a binder resin having improved solubility to a solvent containing THF as a main component is used.

Means for Solving the Problems

The inventors of the present invention paid intensive research efforts to dissolve the conventional problems and, as a result, they found that an electrophotographic photoreceptor using a specific polycarbonate copolymer comprising a constituent unit derived from bis(4-hydroxypheny) methane (hereinafter, "bisphenol F") and a constituent unit derived from other comonomers as a binder resin can exhibit both soil resistance against human body-derived substances and good solubility to a solvent containing THF as a main component by optimizing the proportion of said bisphenol F and other comonomer, and thus completed the present invention.

Thus, the present invention relates to an electrophotographic photoreceptor shown below.

[1] An electrophotographic photoreceptor comprising an electroconductive substrate and a photosensitive layer provided thereon, which is characterized in that a binder resin of said photosensitive layer comprises a polycarbonate resin comprising a constituent unit represented by the following formula (A) and a constituent unit represented by the following formula (B), wherein the content of the constituent unit represented by said formula (A) is 3 to 50% by weight based upon the total constituent units and the intrinsic viscosity thereof is 0.3 to 2 dl/g.

[Chemical Formula 1]

(A)

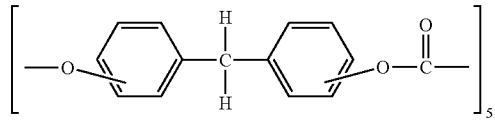

(B)

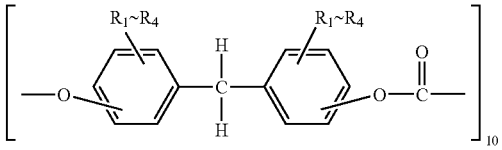

(In the formula (B), $R_1$ to $R_4$, each independently, represent a group selected from the group consisting of a hydrogen atom, a halogen group, an alkyl group having 1-9 carbon atoms, an aryl group having 6-12 carbon atoms, an alkenyl group having 2-5 carbon atoms, an alkoxy group having 1-5 carbon atoms and an aralkyl group having 7-17 carbon atoms. When $R_1$ to $R_4$ are a group containing a carbon atom, the carbon atom can be bonded with a substituent selected from the group consisting of an alkyl group having 1-5 carbon atoms, an alkenyl group having 2-5 carbon atoms, an alkoxy group having 1-5 carbon atoms and a halogen group. X represents a divalent group selected from the group consisting of the structures represented by the following formula (C):

[Chemical Formula 2]

(C)

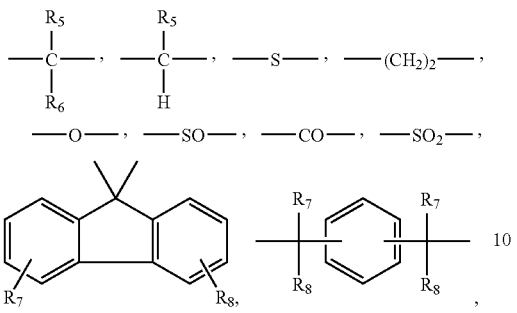

(In the formula (C), each of $R_5$ and $R_6$ represents independently a group selected from the group consisting of a hydrogen atom, a halogen group, an alkyl group having 1-9 carbon atoms, an alkoxy group having 1-5 carbon atoms, and an aryl group having 6-12 carbon atoms, or a group forming a carbon ring or a heterocycle wherein $R_5$ and $R_6$ are bonded with each other. When $R_5$ and $R_6$ are a group containing a carbon atom, the carbon atom can be bonded with a substituent selected from the group consisting of an alkyl group having 1-5 carbon atoms, an alkenyl group having 2-5 carbon atoms, an alkoxy group having 1-5 carbon atoms and a halogen group. "a" represents an integer of 0-20 except for 1.

Each of $R_7$ and $R_8$ independently represents a group selected from the group consisting of a hydrogen atom, a halogen group, an alkyl group having 1-9 carbon atoms, an alkoxy group having 1-9 carbon atoms, and an aryl group having 6-12 carbon atoms, or a group forming a carbon ring or a heterocycle wherein $R_7$ and $R_8$ are bonded with each other. When $R_7$ and $R_8$ are a group containing a carbon atom, the carbon atom can be bonded with a substituent selected from the group consisting of an alkyl group having 1-5 carbon atoms, an alkenyl group having 2-5 carbon atoms, an alkoxy group having 1-5 carbon atoms and a halogen group.)

[2] The electrophotographic photoreceptor according to claim 1, wherein the content of said constituent unit represented by the formula (A) is 5 to 30% by weight based upon the total constituent units.

[3] The electrophotographic photoreceptor according to claim 1 or 2, wherein the intrinsic viscosity of said polycarbonate resin is 0.4 to 1.5 dl/g.

[4] The electrophotographic photoreceptor according to any one of claims 1 to 3, wherein said constituent unit represented by the formula (A) is derived from bis(4-hydroxyphenyl) methane or bis(2-hydroxyphenyl)methane.

[5] The electrophotographic photoreceptor according to any one of claims 1 to 4, wherein said constituent unit represented by the formula (B) is derived from 2,2-bis(4-hydroxyphenyl) propane.

[6] The electrophotographic photoreceptor according to claim 5, wherein the content of said constituent unit represented by the formula (B) is not less than 70% by weight based upon the total constituent units.

Effects of the Invention

The electrophotographic photoreceptor of the present invention uses, as a binder resin, a copolycarbonate resin (polycarbonate copolymer) comprising a constituent unit derived from bisphenol F by a specific rate and is excellent in resistance to soiling by human body-derived substances. Therefore, it is possible to prevent effectively from deterioration of copy images caused by contamination of the surface of an electrophotographic photoreceptor by contaminants.

In addition, since said binder resin has THF solubility equal to conventional binder resins for electrophotographic photoreceptors, it is possible to improve productivity without causing an environmental problem in the process of producing an electrophotographic photoreceptor.

BEST MODE FOR CARRYING OUT THE INVENTION

The electrophotographic photoreceptor of the present invention comprises an electroconductive substrate and a photosensitive layer provided thereon.

(1) Electroconductive Substrate

As an electroconductive substrate of the electrophotographic photoreceptor of the present invention, a metal material such as aluminum, stainless steel and nickel, or a polyester film, a phenol resin film or paper having an electrically conductive layer of aluminum, palladium, tin oxide, indium oxide or the like on the surface thereof can be used.

(2) Photosensitive Layer

As the photosensitive layer of the electrophotographic photoreceptor of the present invention, a single layer type consisting of a single photoconductive layer and a multilayer type having functionally separated layers are included. The multilayer type is consisting of two layers which are a carrier generation layer for generating carrier (charge) by exposure to light and a carrier transport layer for transporting carrier (charge). Recently, a multilayer type electrophotographic photoreceptor is in the main stream. The electrophotographic photoreceptor of the present invention can be any one of the single layer type and the multilayer type, of which the multilayer type is preferable.

If necessary, the electrophotographic photoreceptor of the present invention can apply an underlying layer, a protection layer and/or an adhesive layer in addition to said electroconductive substrate and photosensitive layer.

According to the electrophotographic photoreceptor having multilayer type photosensitive layer, a carrier generation layer is formed on an electroconductive substrate by means of a known method using a binder resin wherein a carrier generation material is dispersed. As carrier generation materials, file-grained organic pigments of azoxybenzenes, disazo compounds, trisazo compounds, benzimidazoles, polycyclic quinolines, indigoids, quinacridones, phthalocyanines, perylenes, methines or the like can be used. These carrier generation materials may be used in the form of fine particles dispersed in a binder resin such as a polyvinyl butyral resin, a polyvinyl formal resin, a silicone resin, a polyamide resin, a polyester resin, a polystyrene resin, a polycarbonate resin, a polyvinyl acetate resin, a polyurethane resin, a phenoxy resin, an epoxy resin and various celluloses.

The carrier transport layer is formed on a carrier generation layer by means of a known method using a binder resin wherein a carrier transport material is dispersed. Examples of carrier transport materials include polytetracyanoethylene; fluorenone compounds such as 2,4,7-trinitro-9-fluorenone; nitro compounds such as dinitroanthracene; succinic anhydride; maleic anhydride; dibromo maleic anhydride; triphenylmethane compounds; oxadiazole compounds such as 2,5-di(4-dimethylaminophenyl)-1,3,4-oxadiazole; styryl compounds such as 9-(4-diethylaminostyryl)anthracene; carbazole compounds such as poly(N-vinylcarbazole); pyrazoline compounds such as 1-phenyl-3-(p-dimethylaminophenyl)pyrazoline; amine derivatives such as 4,4',4"-tris(N,N-diphenylamino)triphenylamine and N,N'-bis(3-methylphenyl)-N,N'-bis(phenyl)benzidine; conjugated unsaturated compounds such as 1,1-bis(4-diethylaminophenyl)-4,4-diphenyl-1,3-butadiene, hydrazone compounds such as 4-(N,N-diethylamino)benzaldehyde-N,N-diphenylhydrazaone; nitrogen-containing cyclic compounds such as indole compounds, oxazole compounds, isooxazole compounds, thiazole compounds, thiadiazole compounds, imidazole compounds, pyrazole compounds, pyrazoline compounds and triazole compounds, and condensed polycyclic compounds. Any of the above listed carrier transport materials can be used alone or in combination of two or more of them with each other.

In the case of an electrophotographic photoreceptor having a single layer type photosensitive layer, said photosensitive layer is formed on a electroconductive substrate by means of a known method using a binder resin wherein the above-mentioned carrier generation material and carrier transport material are dispersed.

(3) Polycarbonate Resin (i) Constituent Units

The electrophotographic photoreceptor of the present invention is characterized in that a polycarbonate resin comprising a constituent unit represented by the following formula (A) (hereinafter, "constituent unit (A)") and a constituent unit represented by the following formula (B) (hereinafter, "constituent unit (B)") is used as a binder resin of its photosensitive layer. That is, in the case of a single layer type, said polycarbonate resin is used as a binder resin of a single photoconductive layer. In the case of a multilayer type, said polycarbonate resin is used as a binder resin of at least a carrier transport layer. It is possible to use the polycarbonate resin not only as a binder resin of the carrier transport layer but also as a binder resin of a carrier generation layer.

[Chemical Formula 3]

(A)

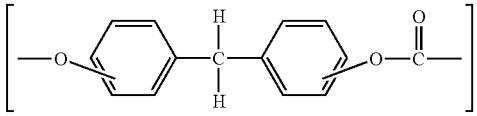

(B)

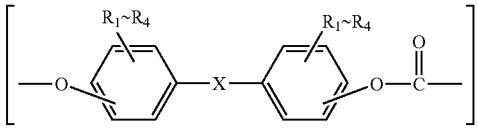

The constituent unit (A) is a carbonate unit derived from bis(4-hydroxyphenyl) methane or bis(2-hydroxyphenyl) methane, more preferably a carbonate unit derived from bis (4-hydroxyphenyl)methane (bisphenol F). The constituent unit (A) can be constituted by only one of the units or can be constituted by two of them.

With regard to the constituent unit (B), in the formula (B), $R_1$ to $R_4$, each independently, represent a group selected from the group consisting of a hydrogen atom, a halogen group, an alkyl group having 1-9 carbon atoms, an aryl group having 6-12 carbon atoms, an alkenyl group having 2-5 carbon atoms, an alkoxy group having 1-5 carbon atoms and an aralkyl group having 7-17 carbon atoms. When $R_1$ to $R_4$ are a group containing a carbon atom, the carbon atom can be bonded with a substituent selected from the group consisting of an alkyl group having 1-5 carbon atoms, an alkenyl group having 2-5 carbon atoms, an alkoxy group having 1-5 carbon atoms and a halogen group. The halogen group is selected from the group consisting of fluorine, chlorine, bromine and iodine.

Suitable examples of $R_1$ to $R_4$ include a hydrogen atom, an alkyl group having 1-9 carbon atoms and a halogen group. Most suitable examples of $R_1$ to $R_4$ include a hydrogen atom.

X in the formula (B) represents a divalent group selected from the group consisting of the structures represented by the following formula (C):

[Chemical Formula 4]

(C)

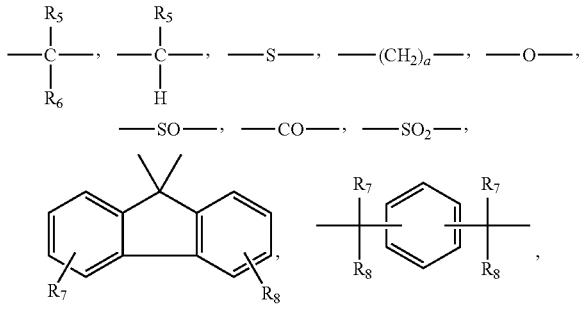

In the formula (C), each of $R_5$ and $R_6$ represents independently a group selected from the group consisting of a hydrogen atom, a halogen group, an alkyl group having 1-9 carbon atoms, an alkoxy group having 1-5 carbon atoms, and an aryl group having 6-12 carbon atoms, or a group forming a carbon ring or a heterocycle wherein $R_5$ and $R_6$ are bonded with each other.

Suitable examples of the carbon ring formed by $R_5$ and $R_6$ bonded with each other include a carbon ring having 5-12 carbon atoms.

When $R_5$ and $R_6$ are a group containing a carbon atom, the carbon atom can be bonded with a substituent selected from the group consisting of an alkyl group having 1-5 carbon atoms, an alkenyl group having 2-5 carbon atoms, an alkoxy group having 1-5 carbon atoms and a halogen group.

Suitable examples of $R_5$ and $R_6$ include a hydrogen atom, an alkyl group having 1-9 carbon atoms and a group forming a carbon ring wherein $R_5$ and $R_6$ are bonded with each other. Most suitable examples of $R_5$ and $R_6$ include a methyl group.

"a" represents an integer of 0-20 except for 1, preferably an integer of 0-10.

Each of $R_7$ and $R_8$ independently represents a group selected from the group consisting of a hydrogen atom, a halogen group, an alkyl group having 1-9 carbon atoms, an alkoxy group having 1-9 carbon atoms, and an aryl group having 6-12 carbon atoms, or a group forming a carbon ring or a heterocycle wherein $R_7$ and $R_8$ are bonded with each other. When $R_7$ and $R_8$ are a group containing a carbon atom, the carbon atom can be bonded with a substituent selected from the group consisting of an alkyl group having 1-5 carbon atoms, an alkenyl group having 2-5 carbon atoms, an alkoxy group having 1-5 carbon atoms and a halogen group. Suitable examples of $R_7$ and $R_8$ include a hydrogen atom and an alkyl group having 1-9 carbon atoms. Most suitable examples of $R_7$ and $R_8$ include a hydrogen atom and a methyl group.

Suitable examples of X include "—$C(R_5)(R_6)$—" wherein $R_5$ and $R_6$ are a methyl group.

Suitable examples of the constituent unit (B) include a carbonate unit derived from bisphenols selected from the group consisting of 1,1'-biphenyl-4,4'-diol, bis(4-hydroxyphenyl)ether, bis(4-hydroxyphenyl)sulfoxide, bis(4-hydroxyphenyl)sulfide, bis(4-hydroxyphenyl)ketone, 1,1-bis(4-hydroxyphenyl)ethane, 2,2-bis(4-hydroxyphenyl)propane (bisphenol A; BPA), 2,2-bis(4-hydroxyphenyl)butane, 2,2-bis(4-hydroxy-3-t-butylphenyl)propane, 1,1-bis(4-hydroxyphenyl)cyclopentane, 1,1-bis(4-hydroxyphenyl)cyclohexane (bisphenol Z; BPZ), 1,1-bis(4-hydroxyphenyl)-3,3,5-trimethylcyclohexane, 2,2-bis(4-hydroxy-3-allylphenyl)propane, 2,2-bis(4-hydroxyphenyl)hexafluoropropane, 1,1-bis(4-hydroxyphenyl)-1-phenylethane, bis(4-hydroxyphenyl)diphenylmethane, 9,9-bis(4-hydroxyphenyl)fluorene, 4,4'-[1,4-phenylene-bis(1-methylethylidene)]bisphenol and 4,4'-[1,3-phenylene-bis(1-methylethylidene)]bisphenol. Among them, a carbonate unit derived from 2,2-bis(4-hydroxyphenyl)propane (bisphenol A) is most preferable.

The constituent unit (B) can be constituted by only one of the units or can be constituted by two or more of them.

(ii) Proportion of Constituent Units

The content of the constituent unit (A) in the above-mentioned polycarbonate resin is preferably 3 to 50% by weight, more preferably 5 to 30% by weight, most preferably 7 to 20% by weight based upon the total constituent units.

When the content of the constituent unit (A) is too low, solubility to a solvent may be deteriorated. When the content thereof is too high, resistance to soiling by a human body-derived substance may be deteriorated.

Though the content of the constituent unit (B) is not particularly limited, it is preferably not less than 50% by weight, more preferably not less than 70% by weight, most preferably not less than 80% by weight based upon the total constituent units. Though the upper limit of the content of the constituent unit (B) is not particularly limited, it is preferably not more than 97% by weight, more preferably not more than 95% by weight based upon the total constituent units.

When this content is too low, resistance to soiling by a human body-derived substance may be deteriorated. When this content is too high, solubility to a solvent may be deteriorated.

Other carbonate units than the above-mentioned constituent units (A) and (B) can be comprised in the polycarbonate resin within the range not impairing the intended effect of the present invention.

The above-mentioned polycarbonate resin can be a random copolymer wherein the constituent unit (A) and (B) and other carbonate units which may be comprised if desired are bonded with each other randomly or a block copolymer wherein said units are bonded in a block form.

(iii) Intrinsic Viscosity

The above-mentioned polycarbonate resin can be molded with ease by means of known wet molding methods employed for manufacturing electrophotographic photoreceptors such as a solution casting method, a casting method, a spray coating method and a dip coating method. The intrinsic viscosity thereof is preferably 0.3 to 2 dl/g for the purpose that the electrophotographic photoreceptor molded by wet molding can obtain a satisfactory level of film strength. Moreover, considering the importance of the film forming property and the film strength, more preferable intrinsic viscosity is 0.4 to 1.5 dl/g.

(4) Process for Producing a Polycarbonate Resin

The polycarbonate resin used for a photosensitive layer of the electrophotographic photoreceptor of the present invention can be produced by reacting bisphenols which derive the constituent unit (A) and the constituent unit (B) and a carbonate-forming compound. Examples of the processes include a known process for producing polycarbonate from bisphenol A and a carbonate-forming compound such as a direct reaction process of bisphenols and phosgene (a phosgene method) and an ester exchange reaction of bisphenols with bisarylcarbonates (a transesterification method).

Of the phosgene method and the transesterification method, the phosgene method is more preferable in terms of the reactivity of bisphenols deriving the constituent unit (A), especially bisphenol F.

Though the bisphenols which derive the constituent unit (B) are not limited as long as they can derive a structure represented by the above formula (B), suitable examples of such bisphenols include 1,1'-biphenyl-4,4'-diol, bis(4-hydroxyphenyl)ether, bis(4-hydroxyphenyl)sulfoxide, bis(4-hydroxyphenyl)sulfide, bis(4-hydroxyphenyl)ketone, 1,1-bis(4-hydroxyphenyl)ethane, 2,2-bis(4-hydroxyphenyl)propane (bisphenol A; BPA), 2,2-bis(4-hydroxyphenyl)butane, 2,2-bis(4-hydroxy-3-t-butylphenyl)propane, 1,1-bis(4-hydroxyphenyl)cyclopentane, 1,1-bis(4-hydroxyphenyl)cyclohexane (bisphenol Z; BPZ), 1,1-bis(4-hydroxyphenyl)-3,3,5-trimethylcyclohexane, 2,2-bis(4-hydroxy-3-allylphenyl)propane, 2,2-bis(4-hydroxyphenyl)hexafluoropropane, 1,1-bis(4-hydroxyphenyl)-1-phenylethane, bis(4-hydroxyphenyl)diphenylmethane, 9,9-bis(4-hydroxyphenyl)fluorene, 4,4'-[1,4-phenylene-bis(1-methylethylidene)]bisphenol and 4,4'-[1,3-phenylene-bis(1-methylethylidene)]bisphenol.

Two or more of them can be used in combination with each other. Among them, 2,2-bis(4-hydroxyphenyl)propane is most preferable.

Examples of carbonate forming compounds include phosgene and bisarylcarbonates such as diphenylcarbonate, di-p-tolylcarbonate, phenyl-p-tolylcarbonate, di-p-chlorophenylcarbonate and dinaphthylcarbonate. Two or more of these compounds can be used in combination with each other.

It is preferable that the bisphenols deriving the constituent unit (A) (bisphenol F) is purified to a purity of 99% or more. The bisphenols of a low degree of purity, especially bisphenols having many isomers such as 2,4'-dihydroxy-diphenylmethane would cause decrease of reactivity, which may bring about the difficulty of control of polymerization.

According to the phosgene method, in general, the bisphenols and bisphenol F and phosgene are brought into reaction with each other under the presence of an acid coupling agent and a solvent. Examples of acid coupling agents include pyridine and hydroxides of alkali metals such as sodium hydroxide and potassium hydroxide. Examples of solvents include methylene chloride and chloroform. In addition, it is preferable to add a catalyst such as tertiary amine such as triethylamine or a quaternary ammonium salt for the purpose of accelerating the condensation polymerization reaction, and to add monofunctional compounds such as phenol, p-t-butylphenol, p-cumylphenol and a long-chain alkyl-substituted phenol as a molecular weight adjuster for the purpose of adjusting the degree of polymerization. If desired, an antioxidant such as sodium sulfite and hydrosulfite and/or a branching agent such as fluoroglycin and isatin bisphenol can be added by a small amount.

It is proper to conduct the reaction, in general, in a temperature range between 0 and 150° C., preferably between 5 and 40° C. While the reaction time may vary depending on the reaction temperature, it is normally between 0.5 minutes and 10 hours, preferably between 1 minute and 2 hours. It is desirable to keep the pH of the reaction system not below 10 during the reaction.

According to the transesterification method, the bisphenols deriving each of the above-mentioned constituent units and bisarylcarbonate are mixed and reacted with each other at high temperature under reduced pressure. The reaction is generally conducted in a temperature range between 150 and 350° C., preferably between 200 and 300° C. The ultimate pressure is preferably reduced to 1 mmHg or less to remove the phenols, which are derived from said bisarylcarbonate generated by the transesterification reaction, from the reaction system by distillation.

While the reaction time varies depending on the reaction temperature and the reduced pressure level, it is generally 1 to 4 hours. The reaction is preferably conducted in an atmosphere of inert gas such as nitrogen or argon. If desired, the reaction may be conducted by adding a molecular weight adjuster, an antioxidant and/or a branching agent.

The polycarbonate resin synthesized from these methods can be molded with ease by way of known wet molding methods generally employed for manufacturing electrophotographic photoreceptors such as a solution casting method, a casting method, a spray coating method and a dip coating method. For an electrophotographic photoreceptor molded by way of a wet molding to obtain satisfactory film strength, the preferable intrinsic viscosity is 0.30-2.0 dl/g, and when the film forming properties and the film strength are considered to be important, the more preferable intrinsic viscosity is 0.40-1.5 dl/g.

(5) Electrophotographic Photoreceptor

The electrophotographic photoreceptor according to the present invention is produced by forming a photosensitive layer (in the case of multilayer type, a carrier generation layer and a carrier transport layer) on an electroconductive substrate.

The photosensitive layer can be formed by coating a solution, which is prepared by dissolving a carrier generation material or a carrier transport material into an appropriate solvent with a binder resin (in the case of multilayer type, each binder resin for carrier generation layer and carrier transport layer respectively), onto a electroconductive substrate by means of a dip coating method, a spray coating method or the like, and subsequently drying the solution. The carrier transport layer is formed by coating a binder resin solution, which is prepared by dissolving a carrier transport material and a binder resin into an appropriate solvent, onto said carrier generation layer by means of a known method and subsequently drying the solution.

Solvents to be used can be roughly classified into halogen type organic solvents and non-halogen type solvents. For the polycarbonate resin of the present invention, it is preferable to use a non-halogen type solvent. While less inflammable halogen type solvents are conventionally used, the percentage of using non-halogen type solvents is being increased from the viewpoint of safety and environmental protection these days. Since the polycarbonate resin of the present invention is excellent in solubility to a non-halogen type solvent containing THF as a main component, it is possible to produce a photosensitive layer using a non-halogen type solvent The non-halogen type solvent to be used in the present invention contains THF as a main component and other components than THF, for the purpose of viscosity control and/or evaporation rate control, example of which include aromatic hydrocarbons such as toluene and xylene, ketones such as acetone, methylethylketone, cyclohexanone and isophoron, ethers such as dioxane and ethylene glycol diethyl ether (except for THF), esters such as methyl acetate, ethyl acetate and ethylcellosolve, alcohols such as methanol, ethanol and isopropanol, as well as dimethyl formamide, dimethyl sulfoxide and diethyl formamide. According to the present invention, these solvents, poor solvents, or non-solvents can be used each independently or two or more of them can be used in combination with each other, together with THF to form a non-halogen type solvent. The proportion of THF in the non-halogen type solvent is preferably not less than 50% by weight, more preferably not less than 60% by weight based upon the total weight of non-halogen type solvent.

In the case that the electrophotographic photoreceptor of the present invention is a single layer type, the above-mentioned polycarbonate resin is used as a binder resin of the photosensitive layer (photoconductive layer). In this case, the mixing ratio of the carrier generation material and the carrier transport layer to the binder resin is preferably within a range between 10:1 and 1:20. The preferable thickness of the photoconductive layer is 2 to 100 μm, more preferably 5 to 30 μm.

In the case of multilayer type, examples of the binder resins for the carrier generation layer include a polyvinyl butyral resin, a polyvinyl formal resin, a silicone resin, a polyamide resin, a polyester resin, a polystyrene resin, a polycarbonate resin, a polyvinyl acetate resin, a polyurethane resin, a phenoxy resin, an epoxy resin and various celluloses. Among them, a polyvinyl butyral resin is preferably used.

The mixing ratio of the carrier generation material and the binder resin is preferably within a range between 10:1 and 1:20. The preferable thickness of the carrier generation layer is 0.01 to 20 μm, more preferably 0.1 to 2 μm.

As the binder resin for the carrier transport layer, the above-mentioned polycarbonate resin is used. The mixing ratio of the carrier transport material and the binder resin is preferably within a range between 10:1 and 1:10. The preferable thickness of the carrier transport layer is 2 to 100 μm, more preferably 5 to 30 μm.

EXAMPLES

The present invention will be described in more detail below referring to Examples. Note that the scope of the present invention is not limited by the following examples.

Example 1

7.2 g (0.036 mol) of bis(4-hydroxyphenyl)methane, manufactured by Asahi Organic Chemicals Industry Co., Ltd. (hereinafter, "BPF"), 65.3 g (0.286 mol) of 2,2-bis(4-hydroxyphenyl)propane manufactured by Mitsui Chemical, Inc. (hereinafter, "BPA"), and 0.1 g of hydrosulfite were dissolved into 530 ml of 8 w/w % aqueous solution of sodium hydroxide. Then, 400 ml of methylene chloride was added to the aqueous solution and 46 g of phosgene was blown into the solution over 30 minutes, while stirring the solution and keeping the temperature of the solution to 15° C. After the completion of blowing phosgene, 0.62 g of p-t-butylphenol (hereinafter, "PTBP") was added and the reaction solution was stirred intensely to be emulsified. After the emulsification, 0.3 ml of triethylamine was added and the emulsion was stirred at 20 to 25° C. for about an hour for polymerization.

After the completion of the polymerization, the reaction solution was separated into an aqueous phase and an organic phase. The organic phase was neutralized by phosphoric acid and was washed repeatedly with water until the electric conductivity of the upper solution (aqueous phase) falls not higher than 10 μS/cm. The obtained polymer solution was dropped into warm water keeping 45° C. and the solvent was removed by evaporation to obtain a white powdery precipitate. The obtained precipitate was filtered and dried at 110° C. for 24 hours to obtain a polymer powder. The intrinsic viscosity of the solution of the polymer in the solvent of methylene chloride with a concentration of 0.5 g/dl at 20° C. was 0.98 dl/g. As a result of analyzing the obtained polymer means of infrared absorption spectrometry, the absorption due to a carbonyl group was observed at a position near 1,770 $cm^{-1}$ and the absorption due to an ether bond was observed at a position near 1,240 $cm^{-1}$. Thus, it was confirmed that the polymer was a polycarbonate resin having a carbonate bond.

Thereafter, a coating solution was prepared by using 50 parts by weight of N,N'-bis(3-methylphenyl)-N,N'-bis(phenyl)benzidine, manufactured by SYNTEC; "ST16/1.2", 50 parts by weight of the polycarbonate resin obtained by above-described synthetic polymerization and 350 parts by weight of THF. The coating solution was coated onto a commercially available LBP photoreceptor (trade name; "LPA3ETC4", manufactured by Seiko Epson Corporation) from which the carrier transport layer had been removed in advance by tetrahydrofuran. The coat was dried in flowing air and then left for drying at 100° C. for 8 hours to form an about 20 μm-thick carrier transport layer. Thus, a multilayer type electrophotographic photoreceptor was reproduced.

On the surface of the photosensitive layer thus prepared, commercially available lotion (manufactured by Johnson & Johnson, trade name; "clean & clear milky lotion Sarasara emulsion") and fat of nose (which was taken from a nose by a finger and accreted onto a surface of the photosensitive layer) as a human body-derived substance, were coated by a cotton bud on a different place with each other within the area of approximately 2 cm at circumferential direction×approximately 3 cm at cylindrical direction, and the electrophotographic photoreceptor was left for 24 hours. Subsequently, the lotion and fat of nose that have been coated were wiped away completely by a nonwoven cloth from the photoreceptor, then the photoreceptor was mounted in the LBP.

The LBP was driven continuously to print an entirely black solid image on 50 sheets and thereafter, image defects of a printed sheet of the side where the lotion and fat of nose were coated on and the presence of cracks on the photosensitive layer were observed by a microscope. The results were shown in Table 1.

Example 2

Synthesis was conducted in the same manner as Example 1 except for 21.2 g (0.106 mol) of BPF and 49.3 g (0.216 mol) of BPA were used.

The intrinsic viscosity of the polycarbonate thus obtained was 0.97 dl/g. The formation of an electrophotographic photoreceptor and evaluations of properties were conducted also in the same manner as Example 1.

Example 3

Synthesis was conducted in the same manner as Example 1 except for 3.6 g (0.018 mol) of BPF and 69.3 g (0.304 mol) of BPA were used.

The intrinsic viscosity of the polycarbonate thus obtained was 0.98 dl/g. The formation of an electrophotographic photoreceptor and evaluations of properties were able to conduct in the same manner as Example 1. However, the life duration of the coating solution prepared was short and it became clouded after 1 week, and thus it can not be reused.

Example 4

Synthesis was conducted in the same manner as Example 1 except for 7.1 g (0.036 mol) of BPF and 50.1 g (0.220 mol) of BPA, and additionally 14.3 g (0.067 mol) of 1,1-bis(4-hydroxyphenyl)ethane (hereinafter, "BPE") were used.

The intrinsic viscosity of the polycarbonate thus obtained was 0.97 dl/g. The formation of an electrophotographic photoreceptor and evaluations of properties were conducted also in the same manner as Example 1.

Example 5

The formation of an electrophotographic photoreceptor and evaluations of properties were conducted in the same manner as Example 1 using the same polycarbonate as in Example 1, except for using 300 parts by weight of THF and 50 parts by weight of toluene in place of 350 ports by weight of THF.

Example 6

Synthesis was conducted in the same manner as Example 1 except that the amount of PTBP was changed to 2.3 g. The intrinsic viscosity of the polycarbonate thus obtained was 0.48 dl/g. The formation of an electrophotographic photoreceptor and evaluations of properties were conducted also in the same manner as Example 1.

Comparative Example 1

The formation of an electrophotographic photoreceptor and evaluations of properties were conducted also in the same manner as Example 1 except for using a BPZ type homopolycarbonate resin having the intrinsic viscosity of 0.98 dl/g, manufactured by Mitsubishi Gas Chemical Co., Inc., trade name: "Iupizeta PCZ-500", which is a commercially available binder resin for an electrophotographic photoreceptor, in place of the polycarbonate resin used in Example 1.

Comparative Example 2

The formation of an electrophotographic photoreceptor and evaluations of properties were attempted to conduct in the same manner as Example 1 except for using a commercially available BPA type homopolycarbonate resin having the intrinsic viscosity of 0.58 dl/g, manufactured by Mitsubishi Engineering-Plastics Corporation, trade name; "Iupilon E-2000" in place of the polycarbonate resin used in Example 1. However, it was unable to form a film because of its insufficient solubility to THF.

Comparative Example 3

Synthesis was conducted in the same manner as Example 1 except that the amount of BPF was change to 40.6 g (0.203 mol) and the amount of BPA was changed to 27.1 g (0.119 mol).

The intrinsic viscosity of the polycarbonate thus obtained was 0.97 dl/g. The formation of an electrophotographic photoreceptor and evaluations of properties were conducted also in the same manner as Example 1 using the polycarbonate resin.

TABLE 1

| | Polymer components (% by weight) | | | Intrinsic Viscosity | Mounting Test | |
|---|---|---|---|---|---|---|
| | BPF | BPA | others | (dl/g) | Image Defects | Crack |
| Examples | | | | | | |
| 1 | 10 | 90 | | 0.98 | ○ | ○ |
| 2 | 30 | 70 | | 0.97 | ○ | Δ |
| 3 | 5 | 95 | | 0.98 | ○ | ○ |
| 4 | 10 | 70 | 20 (BPE) | 0.97 | ○ | ○ |
| 5 | 10 | 90 | | 0.98 | ○ | ○ |
| 6 | 10 | 90 | | 0.48 | ○ | ○ |
| Comp. Examples | | | | | | |
| 1 | — | — | 100 (BPZ) | 0.98 | X | X |
| 2 | — | 100 | — | 0.58 | — | — |
| 3 | 60 | 40 | — | 0.97 | X | X |

BPF: bis(4-hydroxyphenyl)methane

BPA: 2,2-bis(4-hydroxyphenyl)propane

BPE: 1,1-bis(hydroxyphenyl)ethane

BPZ: 1,1-bis(hydroxyphenyl)cyclohexane

Intrinsic viscosity: measured at 20° C. in a 0.5% dichloromethane solution with a Huggins constant of 0.45.

Image Defects: determined by a visual observation of the presence of image defects having a diameter of not smaller than 1 mm after continuously printing an entirely black solid image on 50 A4 size sheets of paper (○: no image defects, x: some image defects). Crack: determined by a visual observation of the presence of cracks by means of a digital microscope of 100 magnification (○: no cracks, Δ: slight cracks x: numbers of cracks).

INDUSTRIAL APPLICABILITY

The present invention can be applied to an electrophotographic photoreceptor excellent in a image stability having improved resistance to soiling by human body-derived substances such as skin fat, fat of nose and fat of hand. In addition, since it uses a binder resin having THF solubility equal to that of the conventional binder resin for an electrophotographic photoreceptor, the productivity of an electrophotographic photoreceptor can be improved without causing an environmental problem.

What is claimed is:

1. An electrophotographic photoreceptor comprising an electroconductive substrate and a photosensitive layer provided thereon, wherein the photosensitive layer comprises a binder resin comprising a polycarbonate resin consisting of a constituent unit represented by the following formula (A) and a constituent unit represented by the following formula (B), wherein the content of the constituent unit represented by formula (A) is 7 to 20% by weight based upon the total constituent units and the intrinsic viscosity thereof is 0.3 to 2 dl/g, (A)

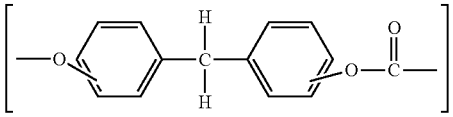

-continued (B)

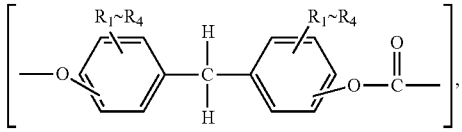

wherein, in formula (B), $R_1$ to $R_4$, each independently, represent a group selected from the group consisting of a hydrogen atom, a halogen group, a $C_{1-9}$ alkyl group, a $C_{6-12}$ aryl group, a $C_{2-5}$ alkenyl group, a $C_{1-5}$ alkoxy group and a $C_{7-17}$ aralkyl group, wherein the $C_{1-9}$ alkyl group, the $C_{6-12}$ aryl group, the $C_{2-5}$ alkenyl group, the $C_{1-5}$ alkoxy group and the $C_{7-17}$ aralkyl group can be bonded to a substituent selected from the group consisting of a $C_{1-5}$ alkyl group, a $C_{2-5}$ alkenyl group, a $C_{1-5}$ alkoxy group and a halogen group; and X represents a divalent group selected from the group consisting of one of the following structures

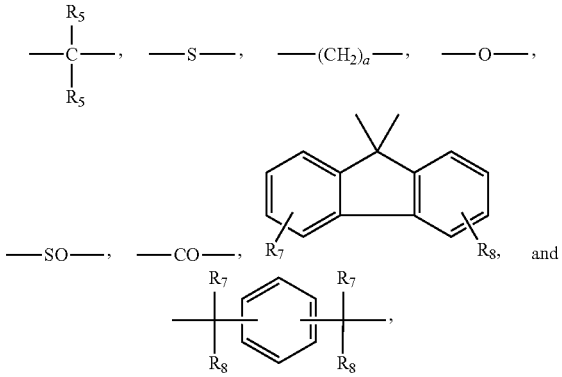

wherein:

$R_5$ represents a group selected from the group consisting of a halogen group, an a $C_{1-9}$ alkyl group, a $C_{1-5}$ alkoxy group and a $C_{6-12}$ aryl group, wherein the $C_{1-9}$ alkyl group, the $C_{1-5}$ alkoxy group and the $C_{6-12}$ aryl group can be bonded to a substituent selected from the group consisting of a $C_{1-5}$ alkyl group, a $C_{2-5}$ alkenyl group, a $C_{1-5}$ alkoxy group and a halogen group, $R_6$ represents a group selected from the group consisting of a hydrogen atom, a halogen group, a $C_{1-9}$ alkyl group, a $C_{1-5}$ alkoxy group and a $C_{6-12}$ aryl group, wherein the $C_{1-9}$ alkyl group, the $C_{1-5}$ alkoxy group and the $C_{6-12}$ aryl group can be bonded to a substituent selected from the group consisting of a $C_{1-5}$ alkyl group, a $C_{2-5}$ alkenyl group, a $C_{1-5}$ alkoxy group and a halogen group, or $R_5$ and $R_6$ represent a group forming a carbon ring or a heterocycle, which can be substituted with a substituent selected from the group consisting of a $C_{1-5}$ alkyl group, a $C_{2-5}$ alkenyl group, a $C_{1-5}$ alkoxy group and a halogen group, wherein $R_5$ and $R_6$ are bonded with each other;

"a" represents an integer of 0-20 other than 1; and each of $R_7$ and $R_8$ independently represents a group selected from the group consisting of a hydrogen atom, a halogen group, a $C_{1-9}$ alkyl group, a $C_{1-9}$ alkoxy group and a $C_{6-12}$ aryl group, wherein the $C_{1-9}$ alkyl group, the $C_{1-9}$ alkoxy group and the $C_{6-12}$ aryl group can be bonded to a substituent selected from the group consisting of a $C_{1-5}$ alkyl group, a $C_{2-5}$ alkenyl group, a $C_{1-5}$ alkoxy group and a halogen group, or $R_7$ and $R_8$ represent a group forming a carbon ring or a heterocycle, which can be substituted with a substituent selected from the group consisting of a $C_{1-5}$ alkyl group, a $C_{2-5}$ alkenyl group, a $C_{1-5}$ alkoxy group and a halogen group, wherein $R_7$ and $R_9$ are bonded with each other.

2. The electrophotographic photoreceptor according to claim 1, wherein the intrinsic viscosity of the polycarbonate resin is 0.4 to 1.5 dl/g.

3. The electrophotographic photoreceptor according to claim 1, wherein the constituent unit represented by formula (A) is derived from bis(4-hydroxyphenyl)methane or bis(2-hydroxyphenyl)methane.

4. The electrophotographic photoreceptor according to claim 1, wherein the constituent unit represented by formula (B) is derived from 2,2-bis(4-hydroxyphenyl)propane.

5. The electrophotographic photoreceptor according to claim 4, wherein the content of the constituent unit represented by formula (B) is not less than 70% by weight based upon the total constituent units.

6. The electrophotographic photoreceptor according to claim 2, wherein the constituent unit represented by formula (A) is derived from bis(4-hydroxyphenyl)methane or bis(2-hydroxyphenyl)methane.

7. The electrophotographic photoreceptor according to claim 2, wherein the constituent unit represented by formula (B) is derived from 2,2-bis(4-hydroxyphenyl)propane.

8. The electrophotographic photoreceptor according to claim 3, wherein the constituent unit represented by formula (B) is derived from 2,2-bis(4-hydroxyphenyl)propane.

* * * * *

UNITED STATES PATENT AND TRADEMARK OFFICE

CERTIFICATE OF CORRECTION

PATENT NO. : 8,574,799 B2
APPLICATION NO. : 12/227356
DATED : November 5, 2013
INVENTOR(S) : Adachi It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 943 days.

Signed and Sealed this
Seventh Day of April, 2015

Michelle K. Lee

Michelle K. Lee
*Director of the United States Patent and Trademark Office*